US011242594B2

(12) United States Patent
Giraud et al.

(10) Patent No.: US 11,242,594 B2
(45) Date of Patent: Feb. 8, 2022

(54) LOW PRESSURE CARBONITRIDING METHOD AND FURNACE

(71) Applicant: ECM TECHNOLOGIES, Grenoble (FR)

(72) Inventors: Yves Giraud, Jarrie (FR); Hubert Mulin, Grenoble (FR)

(73) Assignee: ECM TECHNOLOGIES, Grenoble (FR)

( * ) Notice: Subject to any disclaimer, the term of this patent is extended or adjusted under 35 U.S.C. 154(b) by 1025 days.

(21) Appl. No.: 15/532,270

(22) PCT Filed: Dec. 10, 2015

(86) PCT No.: PCT/FR2015/053419
§ 371 (c)(1),
(2) Date: Jun. 1, 2017

(87) PCT Pub. No.: WO2016/092219
PCT Pub. Date: Jun. 16, 2016

(65) Prior Publication Data

US 2017/0356077 A1 Dec. 14, 2017

(30) Foreign Application Priority Data

Dec. 11, 2014 (FR) ..... 1462260

(51) Int. Cl.
*C23C 8/34* (2006.01)
*C21D 1/06* (2006.01)
*C21D 1/76* (2006.01)

(52) U.S. Cl.
CPC ..... *C23C 8/34* (2013.01); *C21D 1/06* (2013.01); *C21D 1/76* (2013.01)

(58) Field of Classification Search
None
See application file for complete search history.

(56) References Cited

U.S. PATENT DOCUMENTS 8,303,731 B2 11/2012 Berlier et al.
8,784,575 B2 7/2014 Berlier et al.
(Continued)

FOREIGN PATENT DOCUMENTS

CN 1558961 A 12/2004
DE 19909694 A1 9/2000
(Continued)

OTHER PUBLICATIONS

K.-M. Winter, Gas Nitriding and Gas Nitrocarburizing of Steels, ASM Handbook, vol. 4A, Steel Heat Treating Fundamentals and Processes, (Year: 2013).*
(Continued)

*Primary Examiner* — Anthony M Liang
(74) *Attorney, Agent, or Firm* — Moreno IP Law LLC

(57) ABSTRACT

A method for carbonitriding of a steel part arranged in a chamber comprises first steps and second steps, a carburizing gas being injected into the chamber during the first steps only and a nitriding gas being injected into the chamber during the second steps only, at least one of the second steps being situated between two first steps, the pressure in the chamber during at least one part of said two first steps being maintained at a first value and the pressure in the chamber during at least one part of said second step situated between said two first steps being at a second value that is strictly greater than the first value.

15 Claims, 3 Drawing Sheets

(56) References Cited

U.S. PATENT DOCUMENTS

| | | | |
|---|---|---|---|
| 2002/0166607 | A1 | 11/2002 | Altena et al. |
| 2011/0036462 | A1 | 2/2011 | Berlier et al. |
| 2013/0037173 | A1 | 2/2013 | Schwarzer et al. |
| 2013/0042947 | A1 | 2/2013 | Berlier et al. |

FOREIGN PATENT DOCUMENTS

| | | | |
|---|---|---|---|
| FR | 2884523 | A1 | 10/2006 |
| JP | 2013528702 | A | 7/2013 |

OTHER PUBLICATIONS

Translation of Second Office Action in Chinese Patent Application No. 201580067754.1, dated Apr. 11, 2019, 9 pages.
PCT International Search Report; International Application No. PCT/FR2015/053419; dated Mar. 8, 2016, 2 pages.

* cited by examiner

LOW PRESSURE CARBONITRIDING METHOD AND FURNACE

The present patent application claims the priority benefit of French patent application FR14/62260 which is herein incorporated by reference.

BACKGROUND

The present invention relates to steel part treatment methods, and more particularly to carbonitriding methods, that is, methods of introduction of carbon or of nitrogen at the level of the surface of steel parts to improve their hardness and their fatigue strength.

DISCUSSION OF THE RELATED ART

There exist several types of steel part carbonitriding methods enabling to introduce carbon and nitrogen at the level of the surface of the parts down to depths capable of reaching several hundreds of micrometers.

A first category of carbonitriding methods corresponds to so-called high-pressure carbonitriding methods since the chamber containing the parts to be treated is maintained at a pressure generally close to the atmospheric pressure during the entire treatment. Such a method for example comprises maintaining the parts at a temperature hold stage, for example, approximately 880° C., while supplying the chamber with a gaseous mixture made of methanol and of ammonia. The carbonitriding step is followed by a quenching step, for example, an oil quenching, and possibly by a step of strain hardening of the treated parts.

A second category of carbonitriding methods corresponds to so-called low-pressure carbonitriding methods since the chamber containing the parts to be treated is maintained at a pressure generally smaller than a few hundreds of Pascals (a few millibars).

U.S. Pat. No. 8,303,731 describes an example of a low-pressure carbonitriding method comprising an alternation of carburizing steps and of nitriding steps. Although this method provides satisfactory results, it may be desirable, for certain applications, to further increase the nitrogen enrichment at the surface of the treated parts.

SUMMARY

An object of an embodiment is to overcome all or part of the disadvantages of the previously-described low-pressure carbonitriding methods and low-pressure carbonitriding furnaces.

Another object of an embodiment is to accurately and reproducibly obtain desired carbon and nitrogen concentration profiles in the treated parts.

Another object of an embodiment is for the implementation of the carbonitriding method to be compatible with the treatment of steel parts in an industrial context.

Another object of the present invention is for the low-pressure carbonitriding furnace to have a simple structure.

Thus, an embodiment provides a method of carbonitriding a steel part arranged in a chamber, comprising first steps and second steps, a carburizing gas being injected into the chamber only during the first steps and a nitriding gas being injected into the chamber only during the second steps, at least one of the second steps being taking place between two of the first steps, the pressure in the chamber during at least part of said two first steps being maintained at a first value and the pressure in the chamber during at least part of said second step taking place between said two first steps being at a second value greater than the first value.

According to an embodiment, the first value is in the range from 0.1 hPa to 20 hPa, preferably from 0.1 hPa to 10 hPa.

According to an embodiment, the second value is in the range from 10 hPa to 250 hPa, preferably from 30 hPa to 150 hPa.

According to an embodiment, the carburizing gas is propane or acetylene.

According to an embodiment, the nitriding gas is ammonia.

According to an embodiment, the method further comprises third steps, each third step taking place between two of the first steps, between two of the second steps, or between one of the first steps and one of the second steps, a neutral gas being injected into the chamber during each third step.

According to an embodiment, the method further comprises first, second, and third successive steps, the first phase only comprising first steps alternating with third steps, the second phase comprising the successive repetition of a cycle successively comprising a second step, a third step, a first step, and a second step, and the third phase only comprising second steps alternating with third steps.

According to an embodiment, at least one of the third steps directly precedes one of the second steps and the pressure is increased from the first value to the second value during said first step before the beginning of said third step.

According to an embodiment, at least one of the third steps directly precedes one of the second steps and the pressure is maintained at the first value until the end of said first step and is increased from the first value to the second value after the beginning of said third step.

According to an embodiment, the part is maintained at a temperature hold stage.

According to an embodiment, the temperature hold stage is in the range from 800° C. to 1,050° C.

According to an embodiment, the temperature hold stage is greater than 900° C.

An embodiment also provides a carbonitriding furnace intended to receive a steel part, comprising gas introduction and gas extraction circuits, and a control unit capable of controlling the gas introduction and gas extraction circuits to introduce, during first steps and second steps, a carburizing gas into the chamber only during the first steps and a nitriding gas into the chamber only during the second steps, at least one of the second steps taking place between two first steps, and capable of maintaining the pressure in the chamber during at least part of the two first steps at a first value and the pressure in the chamber during at least part of said second step taking place between the two first steps at a second value greater than the first value.

According to an embodiment, the furnace further comprises a heating element and the control unit is capable of controlling the heating element to maintain the part at a temperature hold stage.

BRIEF DESCRIPTION OF THE DRAWINGS

The foregoing and other features and advantages will be discussed in detail in the following non-limiting description of dedicated embodiments in connection with the accompanying drawings, among which.

DETAILED DESCRIPTION OF THE PRESENT EMBODIMENTS

Figure 1:
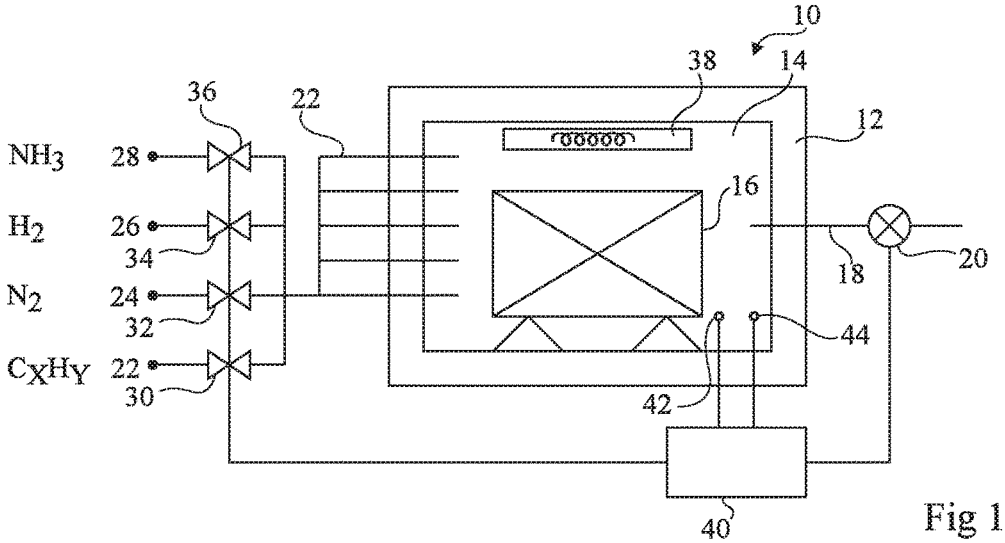
FIG. 1 schematically shows an embodiment of a low-pressure carbonitriding furnace.

The same elements have been designated with the same reference numerals in the different drawings and, further, the various drawings are not to scale. For clarity, only those elements which are useful to the understanding of the described embodiments have been shown and are detailed.

In the following description, unless otherwise specified, expressions "approximately", "substantially", and "in the order of" mean to within 10%, preferably to within 5%. Further, alternation of steps A and B means a succession of steps A and B where each step B, except for the last step in the succession, takes place between two steps A and each step A, except for the initial step in the succession, takes place between two steps B.

According to an embodiment, an alternation of carbon enrichment steps, also called carburizing steps, and of nitrogen enrichment steps, also called nitriding steps, is carried out in a chamber containing steel parts to be treated maintained at a substantially constant temperature at least during part of the carbonitriding method, a carburizing gas being injected into the chamber maintained at a first low pressure during the carburizing steps and a nitriding gas being injected into the chamber maintained at a second pressure greater than the first pressure during the nitriding steps. During each carburizing step, there is no nitriding gas injection into the chamber and during each nitriding step, there is no carburizing gas injection into the chamber.

This advantageously enables to accurately and reproducibly control the carbon and nitrogen concentration profiles obtained in the treated part since the injection of the nitriding gas is carried out separately from the injection of the carburizing gas. Further, since the injection of the nitriding gas is carried out in the chamber while the chamber is maintained at a higher pressure than the pressure in the chamber during the injection of the carburizing gas, the nitrogen enrichment of the treated parts is increased with respect to a method where the same pressure is maintained in the chamber during the injection of the carburizing gas and the injection of the nitriding gas.

A diffusion step during which the injection of the carburizing gas and the injection of the nitriding gas in the chamber are interrupted may be provided between at least one carburizing step and the next nitriding step. Similarly, a diffusion step during which the injection of the carburizing gas and the injection of the nitriding gas in the chamber are interrupted may be provided between at least one nitriding step and the next carburizing step.

FIG. 1 schematically shows an embodiment of a low-pressure carbonitriding furnace 10. Furnace 10 comprises a tight wall 12 delimiting an inner chamber 14 having a feedstock 16 to be treated arranged therein, generally a large number of parts arranged on an appropriate support. A vacuum at a pressure in the range from a few hectopascals (a few millibars) to a few hundreds of hectopascals (a few hundreds of millibars) may be maintained in chamber 14 by means to an extraction pipe 18 connected to a vacuum pump 20. An injector 22 enables to introduce gases in distributed fashion into chamber 14. Gas inlets 22, 24, 26, 28 respectively controlled by valves 30, 32, 34, 36 have been shown as an example. A heating element 38 is arranged in chamber 14. A control unit 40 is connected to valves 30, 32, 34, 36 and to vacuum pump 20, and possibly to heating element 38. Control unit 40 is capable of controlling the closing and the opening of each valve 30, 32, 34, 36. A pressure sensor 42 and a temperature sensor 44 may be provided in chamber 14 and connected to control unit 40. Based on the signal supplied by temperature sensor 44, control unit 40 is capable of controlling heating element 38 to maintain the temperature in chamber 14 at a substantially constant value. Based on the signal supplied by pressure sensor 42, control unit 40 is capable of controlling the suction power of vacuum pump 20 to maintain the pressure in chamber 14 at a set point value. Control unit 40 may comprise a microprocessor or a microcontroller. Control unit 40 may totally or partly correspond to a dedicated circuit or may comprise a processor capable of executing instructions of a computer program stored in a memory.

Figure 2:
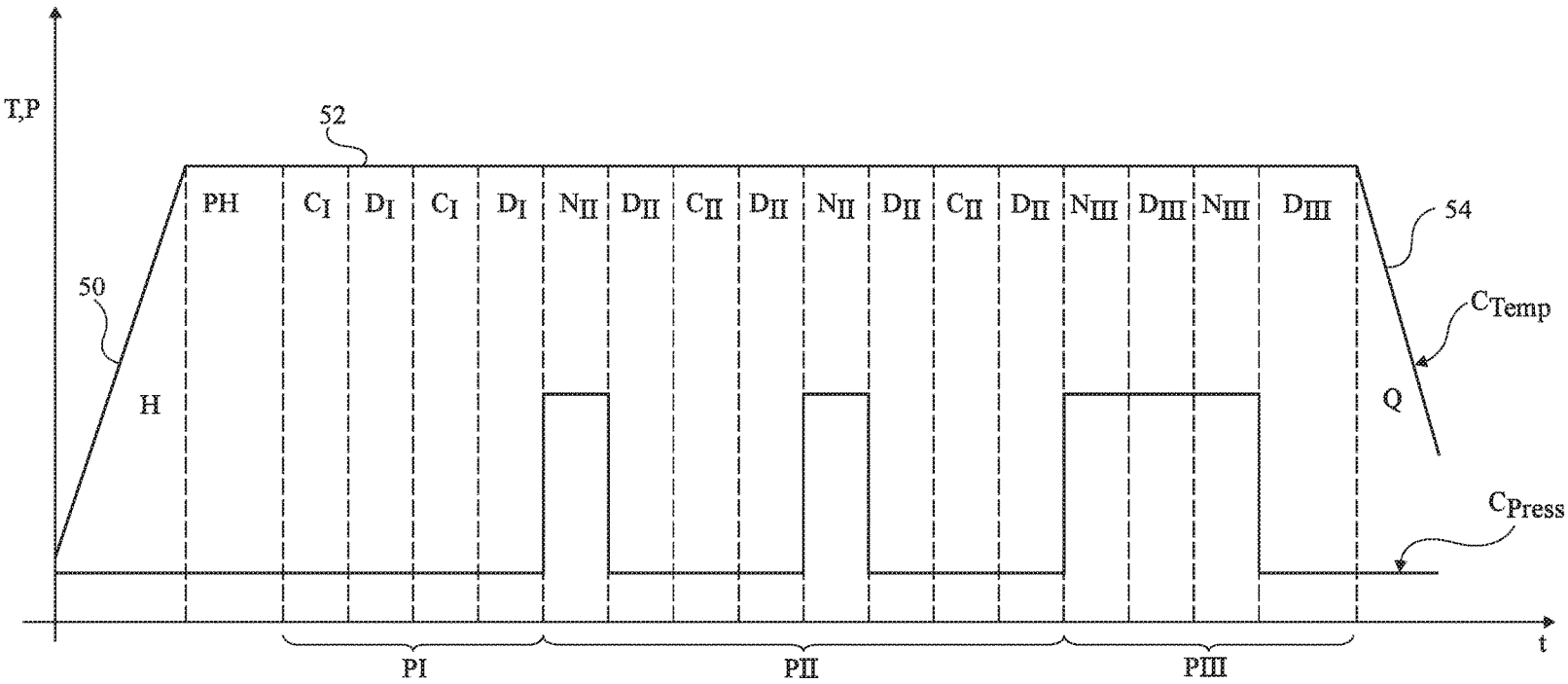
FIG. 2 illustrates an embodiment of a low-pressure carbonitriding method.

FIG. 2 shows a curve $C_{Temp}$ of the temperature variation and a curve $Cp_{res}$ of the pressure variation in chamber 14 of carbonitriding furnace 10 of FIG. 1 during a carbonitriding cycle according to an embodiment of a carbonitriding method.

The method comprises an initial step H corresponding to a rise 50 in the temperature in chamber 14 containing load 16 up to a temperature hold stage 52 which, in the present example, may correspond to a temperature in the range from approximately 800° C. to approximately 1,050° C., preferably from approximately 880° C. to approximately 960° C., for example, in the order of 930° C. Step H is followed by a step PH of equalizing the temperature of the parts forming feedstock 16 at temperature hold stage 52. Steps H and PH may be carried out in the presence of a neutral gas having a reducing gas possibly added thereto. The neutral gas is for example nitrogen ($N_2$). The reducing gas, for example, hydrogen ($H_2$), may be added by a proportion in the range from 1% to 5% by volume of the neutral gas. For safety reasons, it may be desirable to limit the hydrogen content to proportions lower than approximately 5% to prevent any risk of explosion in the case where the hydrogen would incidentally come into contact with the surrounding atmosphere. Step PH is followed by a succession of three phases PI, PII, and PIII. Phases PI, PII, and PIII are carried out while maintaining the temperature in chamber 14 at temperature hold stage 52. A step Q of quenching load 10, for example, a gas quenching, ends the carbonitriding cycle with a temperature decrease 54. Phase PI may be omitted. Similarly, phase PIII may be omitted.

Phase PI comprises an alternation of carbon enrichment steps $C_I$, during which a carburizing gas is injected into chamber 14, and of carbon diffusion steps $D_I$, during which the carburizing gas is no longer injected into chamber 14. Preferably, phase PI comprises at least successively a carburizing step, a diffusion step, a carburizing step, and a diffusion step. As an example, in FIG. 2, phase PI comprises an alternation of two carburizing steps $C_I$ and of two diffusion steps $D_I$. The carburizing gas is for example propane ($C_3H_8$) or acetylene ($C_2H_2$). It may also be any other hydrocarbon ($C_XH_Y$) capable of dissociating at the chamber temperatures to carburize the surface of the parts to be treated.

Phase PII comprises an alternation of nitrogen enrichment steps $N_{II}$, during which a nitriding gas is injected into chamber 14, and of carbon enrichment steps $C_{II}$, during which the carburizing gas is injected to chamber 14. During nitriding steps $N_{II}$, the carburizing gas is not injected into chamber 14 and, during carburizing steps $C_{II}$, the nitriding gas is not injected into chamber 14. According to an embodiment, a nitriding step $N_{II}$ is directly followed by a carburizing step $C_{II}$. According to an embodiment, a carburizing step $C_{II}$, except for the last carburizing step $C_{II}$ of phase PII, is directly followed by a nitriding step $N_{II}$.

According to an embodiment, a diffusion step $D_{II}$ may be provided between each nitriding step $N_{II}$ and the next carburizing step $C_{II}$. According to an embodiment, a diffusion step $D_{II}$ may be provided between each carburizing step $C_{II}$ and the next nitriding step $N_{II}$. Preferably, phase PII comprises at least successively a nitriding step, a diffusion step, a carburizing step, and a diffusion step. As an example, in FIG. 2, phase PII comprises two successive cycles each comprising a nitriding step $N_{II}$, a diffusion step $D_{II}$, a carburizing step $C_{II}$, and a diffusion step $D_{II}$. The nitriding gas is for example ammonia ($NH_3$).

Phase PIII comprises an alternation of nitrogen enrichment steps $N_{III}$ during which the nitriding gas is injected into chamber 14, and of carbon diffusion steps $D_{III}$, during which the nitriding gas is no longer injected into chamber 14. Preferably, phase PIII comprises at least successively one nitriding step, one diffusion step, one nitriding step, and one diffusion step. As an example, in FIG. 2, phase PIII comprises an alternation of two nitriding steps $C_{III}$ and of two diffusion steps $D_{III}$.

Referring to the diagram of FIG. 1, a hydrocarbon ($C_XH_Y$) may be made to arrive onto inlet 22 of valve 30, nitrogen may be made to arrive onto inlet 24 of valve 32, hydrogen may be made to arrive onto inlet 36 of valve 34, and ammonia may be made to arrive onto inlet 28 of valve 36.

The pressure is maintained at a set point value in chamber 14 by vacuum pump 20 controlled by control unit 40. According to an embodiment, during at least some of carburizing steps $C_I$ and $C_{II}$, the pressure in the chamber is, at least during part of these steps, maintained substantially constant at a first value. According to an embodiment, the first value of the pressure is in the range from 0.1 hPa to 20 hPa, preferably from 0.1 hPa to 10 hPa. Preferably, the pressure in chamber 14 is maintained substantially constant at the first value during at least part of each carburizing step $C_I$ of first phase PI. Preferably, the pressure in chamber 14 is maintained substantially constant at the first value during at least part of each carburizing step $C_{II}$ of second phase PII.

According to an embodiment, during at least some of nitriding steps $N_{II}$ and $N_{III}$, the pressure in the chamber is maintained, at least during part of this step, substantially constant at a second value, greater than the first value. According to an embodiment, the second value is in the range from 10 hPa to 250 hPa, preferably from 30 hPa to 150 hPa. Preferably, the pressure in chamber 14 is maintained substantially constant at the second value during each nitriding step $N_{III}$ of third phase PIII. Preferably, the pressure in chamber 14 is maintained substantially constant at the second value during at least part of each nitriding step $N_{II}$ of third phase PII.

The carbonitriding method remains a low-pressure carbonitriding method, since the pressure in chamber 14 is lower than 500 mbar (500 hPa) all along the process.

According to an embodiment, the pressure in chamber 14 is further maintained substantially constant at the first value for at least part of each diffusion step $D_I$ of first phase PI, for at least part of each diffusion step $D_{II}$ of second phase PII, and/or for at least part of each diffusion step $D_{III}$ of third phase PIII. According to an embodiment, the pressure in chamber 14 is, further, maintained substantially constant at the first value during steps H and PH. A neutral gas, for example, nitrogen ($N_2$), may further be injected during steps H and PH and during the carburizing, nitriding, and diffusion steps $C_I$, $C_{II}$, $N_{III}$, $N_{III}$, and $D_I$, $D_{II}$, $D_{III}$. As a variation, the neutral gas may be injected only during diffusion steps $D_I$, $D_{II}$, $D_{III}$ and not be injected during carburizing steps $C_I$, $C_{II}$ and nitriding steps $N_{II}$, $N_{III}$.

The passing of the pressure in chamber 14 from the first value to the second value, greater than the first value, may be obtained by temporarily decreasing, or even stopping, the suction of vacuum pump 20. Preferably, the pressure increase in chamber 14 from the first value to the second value may be carried out within less than 2 minutes, preferably within less than 1 minute.

The passing of the pressure in chamber 14 from the second value to the first value, smaller than the second value, may be obtained by temporarily increasing the suction of vacuum pump 20, to have the pressure in chamber 14 drop, and then by decreasing the suction power of vacuum pump 20 down to a level capable of maintaining the pressure in chamber 14 at the second value. Preferably, the decrease of the pressure in chamber 14 from the second value to the first value may be carried out within less than 2 minutes, preferably within less than 1 minute.

According to an embodiment, all the gases injected into chamber 14 of furnace 10 or some of them may be mixed before the injection into chamber 14. Such a variation for example enables, during the steps of temperature rise H and of temperature equalization PH, to directly inject into chamber 14 a mixture of nitrogen and of hydrogen of the type containing a hydrogen content smaller than 5% by volume, such a hydrogen content excluding any risk of explosion.

FIGS. 3 to 6 respectively show curves $C_1$, $C_2$, $C_3$, $C_4$ of the variation of the pressure in chamber 14 and illustrating different pressure variation configurations during the succession of a first diffusion step D1, which may correspond to a previously-described step $D_{II}$ or step $D_{III}$, of a nitriding step N, which may correspond to a previously-described step $N_{II}$ or step $N_{III}$, and of a second diffusion step D2. In nitriding step N, nitriding gas is injected into chamber 14. During each diffusion step D1 and D2, neutral gas is injected into chamber 14. The injection of neutral gas into chamber 14 may further also be carried out during nitriding step N. The pressure variation is achieved by modifying the suction power of vacuum pump 20. Each curve $C_1$, $C_2$, $C_3$ and $C_4$ comprises a first substantially constant pressure hold stage LP1 at the first value in each diffusion step D1 and D2, a second substantially constant pressure hold stage LP2 at the second value in nitriding step N, a rising phase PUP between stage LP1 and stage PP2 and a falling phase PDOWN between stage LP2 and stage LP1.

Figure 3:
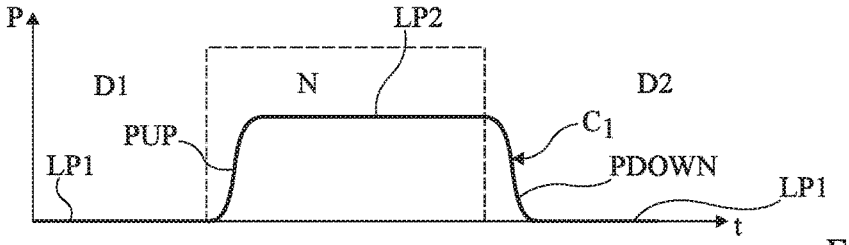
FIGS. 3 to 6 illustrate more detailed embodiments of the pressure variation in the carbonitriding furnace during the implementation of the embodiment of the carbonitriding method illustrated in FIG. 1 between a nitriding step and diffusion steps.
Figure 4:
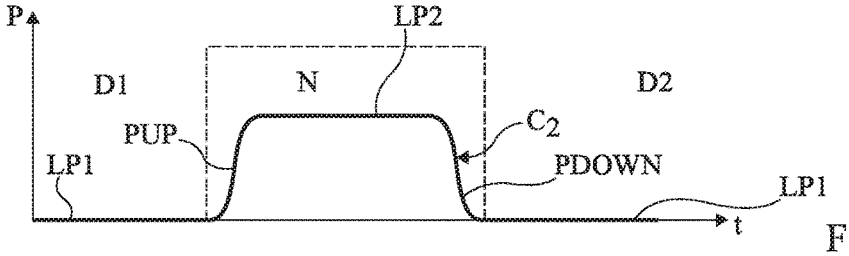
Figure 5:
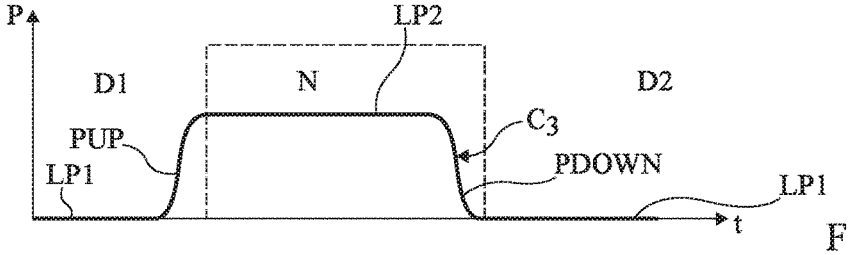
Figure 6:
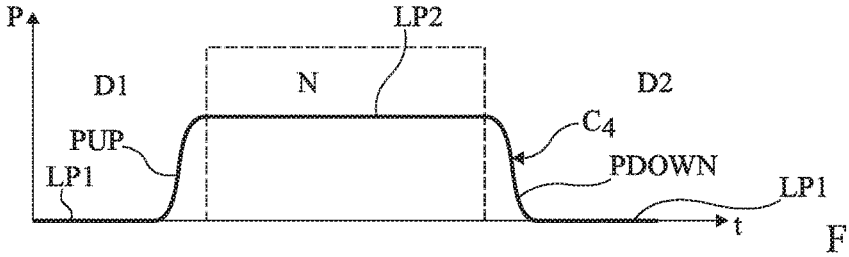

In the embodiment illustrated in FIG. 3, rising phase PUP is achieved in nitriding step N and falling phase PDOWN is achieved in diffusion step D2. In the embodiment illustrated in FIG. 4, rising phase PUP is achieved in nitriding step N and falling phase PDOWN is achieved in nitriding step N. In the embodiment illustrated in FIG. 5, rising phase PUP is achieved in diffusion step D1 and falling phase PDOWN is achieved in nitriding step N. In the embodiment illustrated in FIG. 6, rising phase PUP is achieved in diffusion step D1 and falling phase PDOWN is achieved in diffusion step D2. Nitriding step N is then advantageously carried out at a substantially constant pressure.

Figure 7:
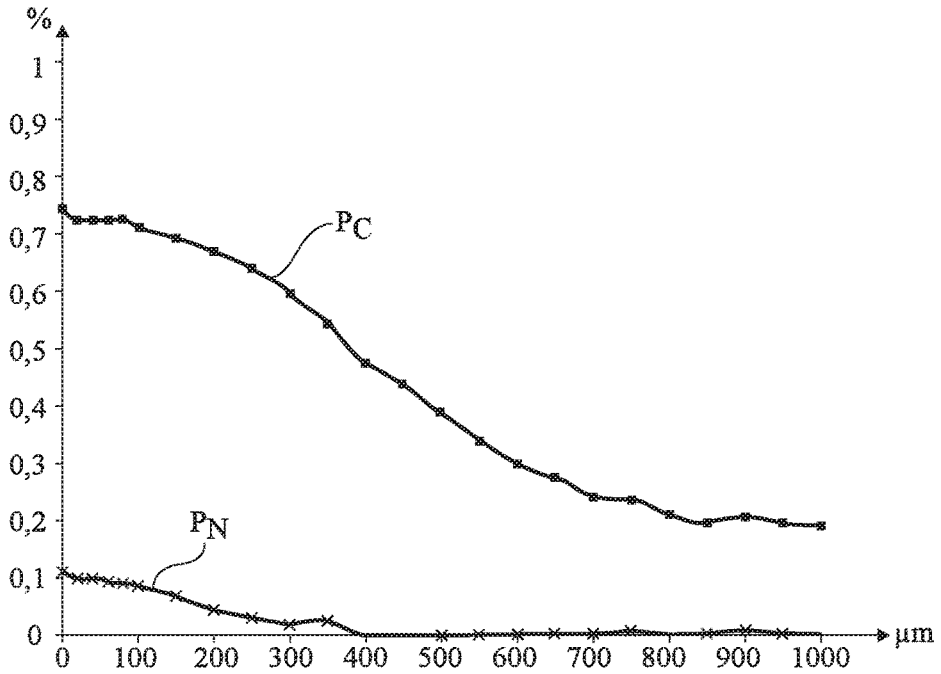
FIGS. 7 and 8 respectively show carbon and nitrogen concentration profiles obtained by implementation of a carbonitriding method according to the embodiment illustrated in FIG. 1 and of a known carbonitriding method.

FIG. 7 shows an example of a weight concentration profile $P_C$ of the carbon element and an example of a weight concentration profile $P_N$ of the nitrogen element having diffused in a part treated according to the depth, measured from the surface of the part on implementation of a first carbonitriding method where the pressure in chamber 14 remains substantially constant at low pressure.

Figure 8:
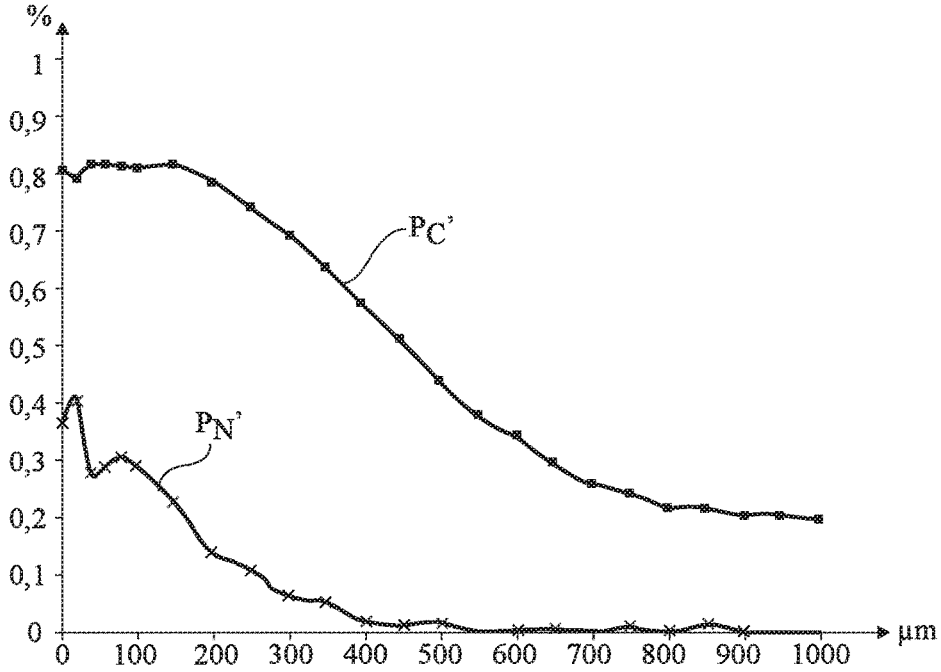

FIG. 8 shows an example of a weight concentration profile $P_{C'}$ of the carbon element and an example of a weight concentration profile $P_{N'}$ of the nitrogen element having diffused in a part treated according to the depth, measured from the surface of the part on implementation of a second carbonitriding method according to the embodiment previously described in relation with FIG. 2, where the pressure is increased during nitriding steps.

For the first and second carbonitriding methods, the carburizing gas was acetylene, the nitriding gas was ammonia, and the neutral gas was nitrogen. In the first and second carbonitriding methods, the carbonitriding was carried out at a 920° C. temperature hold stage. Quenching step Q was a gas quenching.

The first and second carbonitriding methods comprised the steps of:

steps H and PH: 70 minutes as a whole;

phase PI: alternation of four carburizing steps $C_I$ (respectively of 128 s, 60 s, 56 s, and 55 s) and of four diffusion steps $D_I$ (respectively of 185 s, 302 s, 420 s, and 60 s);

phase PII: alternation of three nitriding steps $N_{II}$ (respectively of 394 s, 424 s, and 402 s), of six diffusion steps $D_{II}$ (respectively of 93 s, 120 s, 130 s, 180 s, 227 s, and 120 s), and of three carburizing steps $C_{II}$ (of 54 s each); and phase PIII: alternation of three nitriding steps $N_{III}$ (of 300 s each) and of three diffusion steps $D_{III}$ (respectively of 120 s, 120 s, and 862 s).

The pressure in chamber 14 was maintained substantially at 8 mbar (8 hPa) during all of steps H, PH, $C_I$, $D_I$, $C_{II}$, $D_{II}$, and $D_{III}$ and the pressure in chamber 14 was maintained substantially at 45 mbar (45 hPa) during steps $N_{II}$ and $N_{III}$ except for first step $N_{II}$, which has been carried out at the 8-mbar pressure (8 hPa).

The inventors have shown that the pressure increase during at least certain nitriding steps $N_{II}$ and/or $N_{III}$ enables to obtain an increase in the nitrogen enrichment of the treated parts. In particular, for the first method, the nitrogen concentration was 0.1 wt. % at 25 μm, 0.09 wt. % at 100 μm, 0.045 wt. % at 200 μm, and 0.025 wt. % at 300 μm. For the second method, the nitrogen concentration was 0.4 wt. % at 25 μm, 0.29 wt. % at 100 μm, 0.14 wt. % at 200 μm, and 0.06 wt. % at 300 μm.

The inventors have shown that the pressure increase during at least certain nitriding steps $N_{II}$ and/or $N_{III}$ further enables to obtain an increase in the carbon enrichment of the treated parts. In particular, for the first method, the carbon concentration was 0.725 wt. % at 50 μm, 0.71 wt. % at 100 μm, 0.675 wt. % at 200 μm, and 0.6 wt. % at 300 μm. For the second method, the carbon concentration was 0.8 wt. % at 50 μm, 0.8 wt. % at 100 μm, 0.775 wt. % at 200 μm, and 0.68 wt. % at 300 μm.

According to a variation of the invention, the nitriding gas may be injected during temperature rise step H, as soon as the temperature in chamber 14 exceeds a given temperature, and/or during temperature equalization step PH. As an example, when the nitriding gas is ammonia, the injection may be performed as soon as the temperature in chamber 14 exceeds approximately 800° C.

The fact for the carburizing and nitriding gases not to be simultaneously injected enables to increase the pressure in chamber 14 during at least some of nitriding steps $N_{II}$ and/or $N_{III}$. This causes a better nitrogen and carbon enrichment of the treated parts.

Further, the fact for the carburizing and nitriding gases not to be simultaneously injected enables to accurately and reproducibly obtain the desired carbon and nitrogen concentration profiles. Indeed, when the nitriding gas is injected simultaneously to the carburizing gas, a dilution of the carburizing gas and of the nitriding gas occurs. This is not a factor favoring the reaction of the carbon originating from the carburizing gas or the reaction of the nitrogen originating from the nitriding gas with the parts to be treated, which slows down the nitrogen and carbon enrichment of the parts. Further, when the carburizing gas and the nitriding gas are mixed, it is difficult to achieve an accurate control of the gaseous environment in chamber 14, which makes it more difficult to accurately and reproducibly obtain the desired nitrogen and carbon concentration profiles of the treated parts.

Of course, the present invention is likely to have various alterations and modifications which will occur to those skilled in the art. As an example, the previously-described gas quenching step may be replaced with an oil quenching step.

What is claimed is:

1. A method of carbonitriding a steel part arranged in a chamber, comprising first steps and second steps, a carburizing gas being injected into the chamber only during the first steps and a nitriding gas being injected into the chamber only during the second steps, at least one of the second steps taking place between two of the first steps, the pressure in the chamber during at least part of said two first steps being maintained at a first value and the pressure in the chamber during at least part of said second step taking place between said two first steps being at a second value greater than the first value, the pressure in chamber being kept lower than 500 hPa all along the carbonitriding process.

2. The method of claim 1, wherein the first value is in the range from 0.1 hPa to 20 hPa.

3. The method of claim 1, wherein the second value is in the range from 10 hPa to 250 hPa.

4. The method of claim 1, wherein the carburizing gas is propane or acetylene.

5. The method of claim 1, wherein the nitriding gas is ammonia.

6. The method of claim 1, further comprising third steps, each third step taking place between two of the first steps, between two of the second steps, or between one of the first steps and one of the second steps, a neutral gas being injected into the chamber during each third step.

7. The method of claim 6, further comprising first, second, and third successive phases, and wherein the first phase only comprises first steps alternating with third steps, wherein the second phase comprises the successive repetition of a cycle successively comprising a second step, a third step, a first step, and a second step, and wherein the third phase only comprises second steps alternating with third steps.

8. The method of claim 6, wherein at least one of the third steps directly precedes one of the second steps and wherein the pressure is increased from the first value to the second value during said third step before the beginning of said second step.

9. The method of claim 6, wherein at least one of the third steps directly precedes one of the second steps and wherein the pressure is maintained at the first value until the end of said second step and is increased from the first value to the second value after the beginning of said third step.

10. The method of claim 1, wherein the part is maintained at a temperature hold stage.

11. The method of claim 10, wherein the temperature hold stage is in the range from 800° C. to 1,050° C.

12. The method of claim 11, wherein the temperature hold stage is greater than 900° C.

13. The method of claim 6, wherein the pressure in the chamber during at least part of said third steps is maintained at the first value.

14. The method of claim 6, wherein at least one of the third steps directly follows one of the second steps and wherein the pressure is decreased from the second value to the first value during said second step before the beginning of said third step.

15. The method of claim 6, wherein at least one of the third steps directly follows one of the second steps and wherein the pressure is maintained at the second value until the end of said second step and is decreased from the second value to the first value after the beginning of said third step.

* * * * *